US010287523B2

(12) United States Patent
Nakagawa et al.

(10) Patent No.: US 10,287,523 B2
(45) Date of Patent: May 14, 2019

(54) COAL DEACTIVATION PROCESSING DEVICE

(71) Applicant: MITSUBISHI HEAVY INDUSTRIES, LTD., Tokyo (JP)

(72) Inventors: Keiichi Nakagawa, Tokyo (JP); Setsuo Omoto, Tokyo (JP)

(73) Assignee: MITSUBISHI HEAVY INDUSTRIES ENGINEERING, LTD., Kanagawa (JP)

( * ) Notice: Subject to any disclaimer, the term of this patent is extended or adjusted under 35 U.S.C. 154(b) by 242 days.

(21) Appl. No.: 15/038,600

(22) PCT Filed: Nov. 12, 2014

(86) PCT No.: PCT/JP2014/079916
§ 371 (c)(1),
(2) Date: May 23, 2016

(87) PCT Pub. No.: WO2015/083509
PCT Pub. Date: Jun. 11, 2015

(65) Prior Publication Data

US 2016/0298044 A1 Oct. 13, 2016

(30) Foreign Application Priority Data

Dec. 6, 2013 (JP) ..... 2013-252743

(51) Int. Cl.
*C10L 5/04* (2006.01)
*C10L 9/00* (2006.01)
(Continued)

(52) U.S. Cl.
CPC ..... *C10L 5/04* (2013.01); *C10L 9/00* (2013.01); *C10L 9/08* (2013.01); *C10L 9/12* (2013.01);
(Continued)

(58) Field of Classification Search
CPC .... C10L 5/04; C10L 5/447; C10L 9/06; C10L 2290/06; Y02E 50/30; Y02E 50/10
(Continued)

(56) References Cited

U.S. PATENT DOCUMENTS 3,208,512 A * 9/1965 Kalmbach ..... F27B 7/14 165/88
3,765,102 A 10/1973 Fischer
(Continued)

FOREIGN PATENT DOCUMENTS

AU 578553 B2 10/1988
CN 86 1 08589 A 7/1987
(Continued)

OTHER PUBLICATIONS

Office Action dated Oct. 28, 2016, issued in counterpart Australian Patent Application No. 2014358471. (5 pages).
(Continued)

*Primary Examiner* — Pamela H Weiss
(74) *Attorney, Agent, or Firm* — Westerman, Hattori, Daniels & Adrian, LLP

(57) ABSTRACT

A coal deactivation processing device includes: a rotary kiln body provided rotatably into which coal and a processing gas are supplied; and a feed pipe provided so as to be able to rotate along with the rotary kiln body, extending along a lengthwise direction of the rotary kiln body, and having a coolant flowing therein. A pair of blades is provided on an outer circumferential section of the feed pipe and protrudes in a radial direction. The feed pipe and the pair of blades are arranged so as to pass through an accumulated coal layer of the coal within the rotary kiln body upon rotation of the rotary kiln body, and such that an angle formed by a tangent of a path along which the central axis of the feed pipe passes and the bisector of the pair of blades is from 0 to 40 degrees.

2 Claims, 3 Drawing Sheets

(51) Int. Cl.

| | |
|---|---|
| ***C10L 9/08*** | (2006.01) |
| ***F27B 7/36*** | (2006.01) |
| ***F27B 7/32*** | (2006.01) |
| ***C10L 9/12*** | (2006.01) |
| ***F27D 9/00*** | (2006.01) |
| ***F27B 7/38*** | (2006.01) |
| ***F27B 7/33*** | (2006.01) |

(52) U.S. Cl.
CPC ..... *F27B 7/32* (2013.01); *F27B 7/33* (2013.01); *F27B 7/36* (2013.01); *F27B 7/38* (2013.01); *F27D 9/00* (2013.01); *C10L 2290/06* (2013.01)

(58) Field of Classification Search
USPC ..... 48/63, 68, 210; 110/226, 235; 202/100, 202/211, 218, 228
See application file for complete search history.

(56) References Cited

U.S. PATENT DOCUMENTS

| | | | |
|---|---|---|---|
| 5,840,651 | A | 11/1998 | Hanashita et al. |
| 6,436,158 | B1 | 8/2002 | Fujikawa et al. |
| 2007/0031772 | A1 | 2/2007 | Von Blucher et al. |

FOREIGN PATENT DOCUMENTS

| | | | |
|---|---|---|---|
| CN | 102965173 | A | 3/2013 |
| EP | 0370144 | A1 | 5/1990 |
| EP | 1 748 269 | A2 | 1/2007 |
| JP | 11-310785 | A | 11/1999 |
| JP | 2002-130629 | A | 5/2002 |
| JP | 2007-031275 | A | 2/2007 |
| JP | 2007-237011 | A | 9/2007 |
| JP | 2012-126856 | A | 7/2012 |
| JP | 2013-139536 | A | 7/2013 |
| JP | 2013-189554 | A | 9/2013 |
| WO | 95/013868 | A1 | 5/1995 |
| WO | 2013/136944 | A1 | 9/2013 |

OTHER PUBLICATIONS

Office Action dated Jan. 3, 2017, issued in counterpart Chinese Application No. 201480064760.7, with English translation. (11 pages).

Notification of Transmittal of Copies of Translation of the International Preliminary Report on Patentability (Form PCT/IB/338) of International Application No. PCT/JP2014/079916 dated Jun. 16, 2016, with Forms PCT/IB/373 and PCT/ISA/237. (6 pages).

International Search Report dated Jan. 27, 2015, issued in International Patent Application No. PCT/JP2014/079916, with English translation. (10 pages).

* cited by examiner

COAL DEACTIVATION PROCESSING DEVICE

TECHNICAL FIELD

The present invention pertains to a coal deactivation processing device performing deactivation processing of coal with a processing gas that contains oxygen.

BACKGROUND ART

Dry distilled coal has an active surface that is prone to bonding with oxygen. As such, storage as-is poses a risk of spontaneous combustion due to the heat of reaction with oxygen in the air. For this reason, there are attempts to prevent spontaneous combustion during storage by deactivating the coal through oxygen bonding on the surface of the coal ahead of time, performed by exposing the dry distilled coal to an atmosphere of processing gas that includes oxygen.

CITATION LIST

Patent Literature(s)

Patent Document 1: Japanese Unexamined Patent Application Publication No. 2007-237011
Patent Document 2: WO/95/13868

SUMMARY OF THE INVENTION

Technical Problem

Coal deactivation processing devices for performing deactivation processing of dry distilled coal have been developed. Such coal deactivation processing devices are provided with a rotary kiln and feed pipes. Dry distilled coal and a processing gas are supplied into the rotary kiln. The feed pipes are arranged within the rotary kiln neighboring each other in the circumferential direction. A coolant flows in each feed pipe.

The above-described coal deactivation processing devices cause the rotary kiln and the plurality of feed pipes to rotate. As such, the coal is agitated by the rotation of the rotary kiln while the coolant flowing within the feed pipes cools the coal. In addition, the plurality of feed pipes pass through an accumulated coal layer of the coal within the rotary kiln and lift the coal higher than a coal layer surface, then drop the coal onto the coal layer surface from above, thereby further agitating the coal. Then, the deactivation processing of the coal is performed by the processing gas.

However, a coal deactivation processing device performing the deactivation processing of the coal in a more efficient manner is being sought.

In consideration of this background, the present invention has been made in order to solve the above-described problem, and an object thereof is to provide a coal deactivation processing device enabling oxygen to be adsorbed to the surface of the coal in an efficient manner while preventing spontaneous combustion of the coal.

Solution to Problem

A coal deactivation processing device according to a first aspect of the invention and solving the above-described problem performs deactivation of coal with a processing gas that includes oxygen. The coal deactivation processing device includes a kiln body provided rotatably into which the coal and the processing gas are supplied, and with a feed pipe provided so as to be able to rotate along with the kiln body, extending along a lengthwise direction of the kiln body, and having a coolant flowing therein. A pair of blades is provided on an outer circumferential section of the feed pipe and protrude in a radial direction. The feed pipe and the pair of blades are arranged so as to pass through an accumulated coal layer of the coal within the kiln body upon rotation of the kiln body, and such that an angle formed by a tangent line of a path along which the central axis of the feed pipe passes and a bisector line of the pair blades is from 0 to 40°.

A coal deactivation processing device according to a second aspect of the invention and solving the above-described problem is the coal deactivation processing device according to the above-described first aspect, with the pair of blades being arranged such that a blade angle formed by one blade of the pair of blades and the bisector line of the pair of blades is greater than an angle of repose.

A coal deactivation processing device according to a third aspect of the invention and solving the above-described problem is the coal deactivation processing device according to the above-described second aspect, where the blade angle is from 45 to 85°.

A coal deactivation processing device according to a fourth aspect of the invention and solving the above-described problem is the coal deactivation processing device according to any one of the above-described first to third aspects, where a minimum blade length in the radial direction of the feed pipe is from 5 to 45% of a radius of the feed pipe.

Advantageous Effects of Invention

According to the coal deactivation processing device pertaining to the present invention, the feed pipe and the pair of blades are arranged so as to pass through an accumulated coal layer of the coal upon rotation of the kiln body, and are disposed such that the angle formed by the tangent line of the path along which the central axis of the feed pipe passes and the bisector line of the pair of blades is from 0 to 40°. As such, the coal is agitated by the rotation of the kiln body while the coal is also cooled by the coolant flowing in the feed pipe. In addition, a predetermined volume of the coal is lifted up by the feed pipe and the pair of blades higher than the coal layer surface within the kiln body and dropped from above, thus further agitating the coal and bringing the coal and the processing gas into contact in an efficient manner. As a result, the spontaneous combustion of the coal may be prevented while causing oxygen to be adsorbed to the surface of the coal in an efficient manner. As such, in comparison to a situation in which the blades are not provided on the feed pipe, the overall length of the kiln body may be made shorter, thus enabling miniaturization of the device.

BRIEF DESCRIPTION OF DRAWING(S)

DESCRIPTION OF EMBODIMENTS

An embodiment of the coal deactivation processing device pertaining to the present invention is described with reference to the drawings. However, the present invention is not limited merely to the following embodiment as described with reference to the drawings.

The embodiment of the coal deactivation processing device pertaining to the present invention is described with reference to FIG. 1 to FIG. 3.

Figure 1:
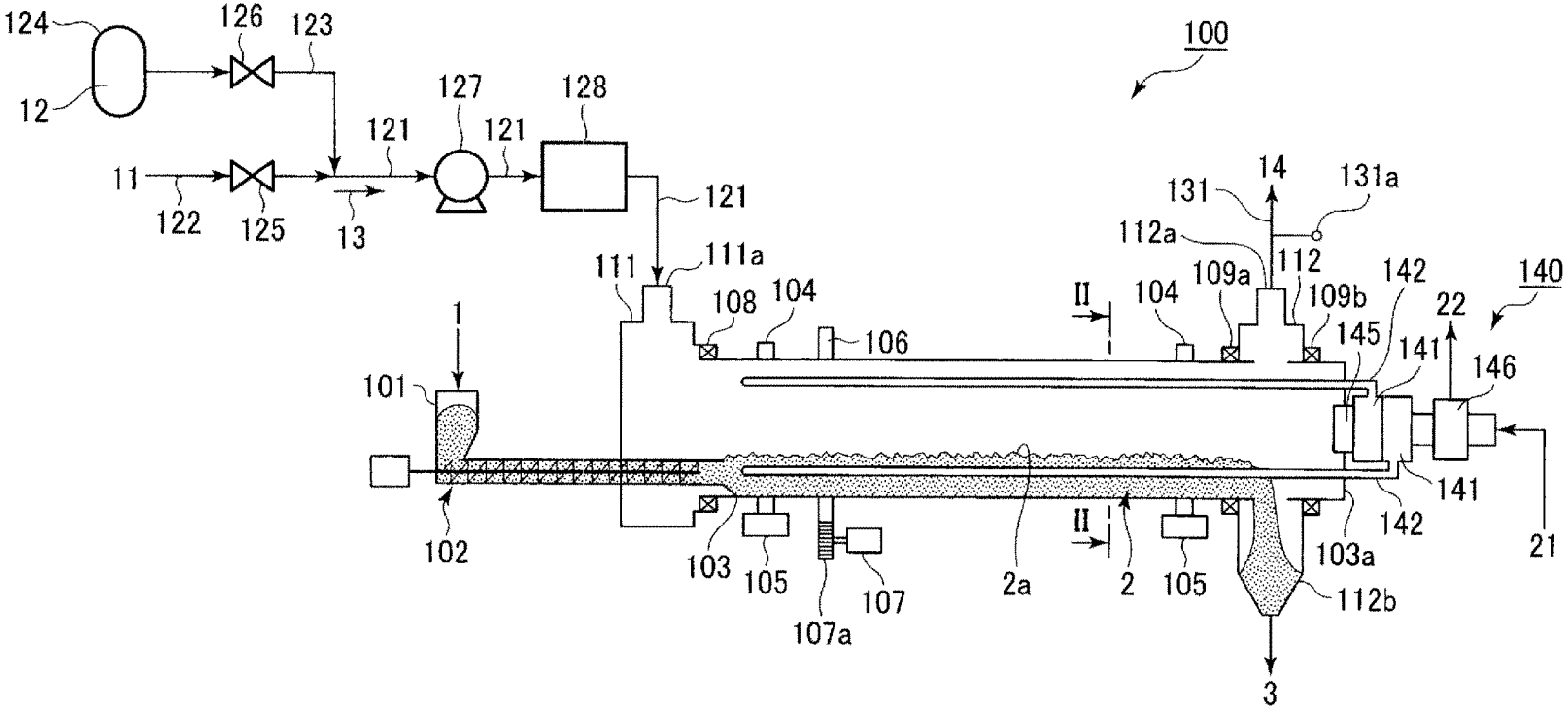
FIG. 1 is an overall configuration view of an embodiment of a coal deactivation processing device pertaining to the present invention.

As illustrated in FIG. 1, a coal deactivation processing device 100, performing deactivation processing of dry distilled coal 1, is equipped with a hopper 101 receiving the dry distilled coal 1 and with a screw feeder 102 provided with a base end side being continuous with a feed aperture of the hopper 101 and serving as rotational transport means of transporting the coal 1 within the hopper 101 from one end side (the base end side) to another end side (a tip end side) via rotation.

The tip end side of the screw feeder 102 is continuous with a base end side of a rotary kiln body (kiln body) 103 having a tubular shape. The base end side of the rotary kiln body 103 is continuous with a base end side casing 111 via a sealing device 108. A gas intake aperture 111*a* taking in a processing gas 13 is provided on a top portion of the base end side casing 111. The gas intake aperture 111*a* is connected to a tip end side of a processing gas supply pipe 121 supplying the processing gas 13. A blower 127 and a heating device 128 are provided in the path of the processing gas supply pipe 121.

A tip end side of an air supply pipe 122 supplying air 11 and a tip end side of a nitrogen supply pipe 123 supplying nitrogen gas 12 are respectively connected to the base end side of the processing gas supply pipe 121. The base end side of the air supply pipe 122 is open to the atmosphere. The base end side of the nitrogen supply pipe 123 is connected to a nitrogen supply source 124, such as a nitrogen gas tank. Flow rate regulation valves 125, 126 are respectively provided in the paths of the air supply pipe 122 and the nitrogen supply pipe 123.

The tip end side of the rotary kiln body 103 is continuous with a tip end side casing 112 via sealing devices 109*a*, 109*b*. A gas ejection aperture 112*a* ejecting used processing gas 14 is provided on a top portion of the tip end side casing 112. The gas ejection aperture 112*a* is connected to a base end side of a processing gas ejection pipe 131 ejecting the used processing gas 14. A temperature sensor 131*a* is provided in the path of the processing gas ejection pipe 131. A chute 112*b* dropping and ejecting deactivation processed coal (upgraded coal) 3 is provided on a bottom portion of the tip end side casing 112.

A projecting portion 104 having a ring shape is provided on the tip end side and the base end side of an outer circumferential section of the rotary kiln body 103. The projecting portion 104 is supported by a roller 105. A gear 106 engaging with a gear 107*a* of a drive motor 107 is provided on the outer circumferential section of the rotary kiln body 103. As a result, the rotary kiln body 103 is made to rotate by the rotation of the gear 107*a* of the drive motor 107.

The above-described coal deactivation processing device 100 is further equipped with a cooling device 140. The cooling device 140 is equipped with a bearing 145 fixed to a side wall portion 103*a* of the tip end side of the rotary kiln body 103. The cooling device 140 is equipped with a coolant feed header 141 feeding a coolant 21 from outside the system. The coolant feed header 141 is provided on the bearing 145. The coolant feed header 141 is connected to a feed pipe 142 feeding the coolant 21. The feed pipe 142 is provided in plurality (for example, as a double pipe) with, for example, eight pipes being connected (see FIG. 2). The cooling device 140 is equipped with a coolant ejection header 146 ejecting used coolant 22 that has passed through the feed pipes 142 to outside the system.

Figure 2:
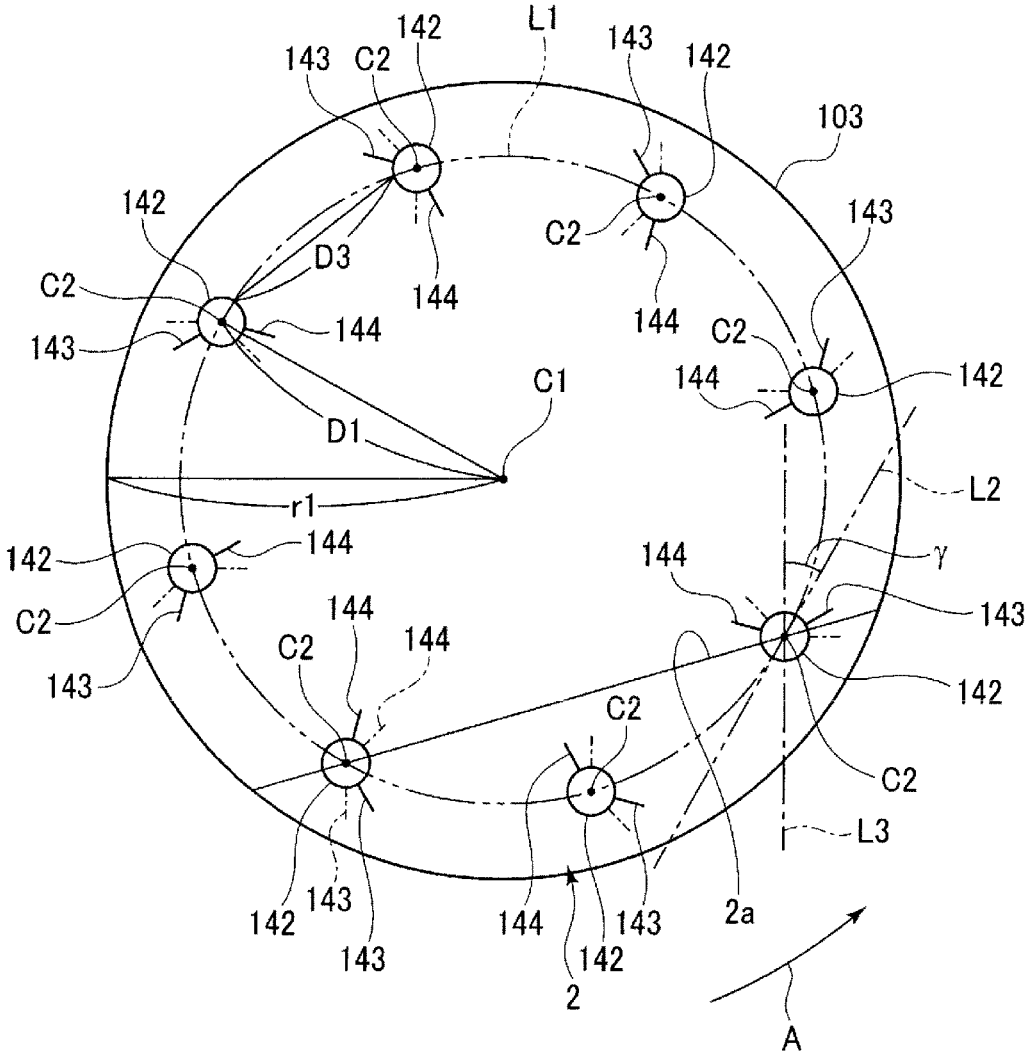
FIG. 2 is a magnified view of a cross section taken along line II-II of FIG. 1.

The plurality of feed pipes 142 are arranged, as illustrated in FIG. 1 and FIG. 2, within the rotary kiln body 103 so as to neighbor each other with equal spacing along a circumferential direction of the rotary kiln body 103. The plurality of feed pipes 142 are arranged at respective positions so as to, upon rotation of the rotary kiln body 103, pass through an accumulated coal layer of the coal 2 despite a fill ratio of the coal 2 within the rotary kiln body 103 being from 10 to 15%, for example. In addition, the plurality of feed pipes 142 are arranged such that a distance D1 from a respective central axis C2 of each of the feed pipes 142 to a central axis C1 of the rotary kiln body 103 is consistently equal. The plurality of feed pipes 142 extend in parallel to the central axis C1 of the rotary kiln body 103 within the rotary kiln body 103, and extend across the rotary kiln body 103 from the tip end side to the base end side. As a result, the temperature of a region where the coal 2 undergoes deactivation processing by the processing gas 13 supplied within the rotary kiln body 103 is adjusted by the coolant 21 flowing within the feed pipes 142 to a temperature at which spontaneous combustion of the coal 2 does not occur.

The plurality of feed pipes 142 are arranged so as to pass through the side wall portion 103*a* of the rotary kiln body 103. The plurality of feed pipes 142 are each supported by support jigs (not illustrated in the drawings) arranged at a plurality of locations in a lengthwise direction. As a result, the plurality of feed pipes 142 are made to rotate along with the rotary kiln body 103 upon rotation of the rotary kiln body 103.

Here, the parameters of the above-described feed pipes 142 are described with reference to FIG. 2 and FIG. 3.

In FIG. 2, a direction of rotation A is a direction of rotation of the rotary kiln body 103. A path L1 is followed by the central axis C2 of each of the plurality of feed pipes 142, and a tangent line L2 is tangent to the path L1. An angle $\gamma$ is an acute angle formed by the tangent line L2 and a bisector line L3, described below. In FIG. 2 and FIG. 3, the bisector line L3 bisects a pair of blades 143, 144, described later. In FIG. 3, a lateral symmetry line L4 indicates the symmetry of a coal layer surface 2*a*. A support line L11 passes through a point of contact P1 between one of the feed pipes 142 and the coal layer surface 2*a* and a point of contact P2 between the feed pipe 142 and the lateral symmetry line L4 of the coal layer surface 2*a*. Support lines L12, L13 respectively pass through the central axis C2 of the feed pipe 142 and the points of contact P1, P2. Support lines L21, L22 respectively pass through the blades 144, 143 and the central axis C2 of the feed pipe 142. An angle $\alpha$ is an acute angle formed by the bisector line L3 and the support line L21 (line extending from the blade 144), and represents a blade angle. An angle $\beta$ is an acute angle similarly formed by the bisector line L3 and the support line L12. An angle of repose $\theta$ is also indicated. Here, the support lines L11, L12, L13 form an isosceles triangle with the central axis C2 at the vertex. Given that the support line L12 and the coal layer surface layer 2*a* form a right angle, the angle $\beta$ is thus equal to the angle of repose $\theta$.

Figure 3:
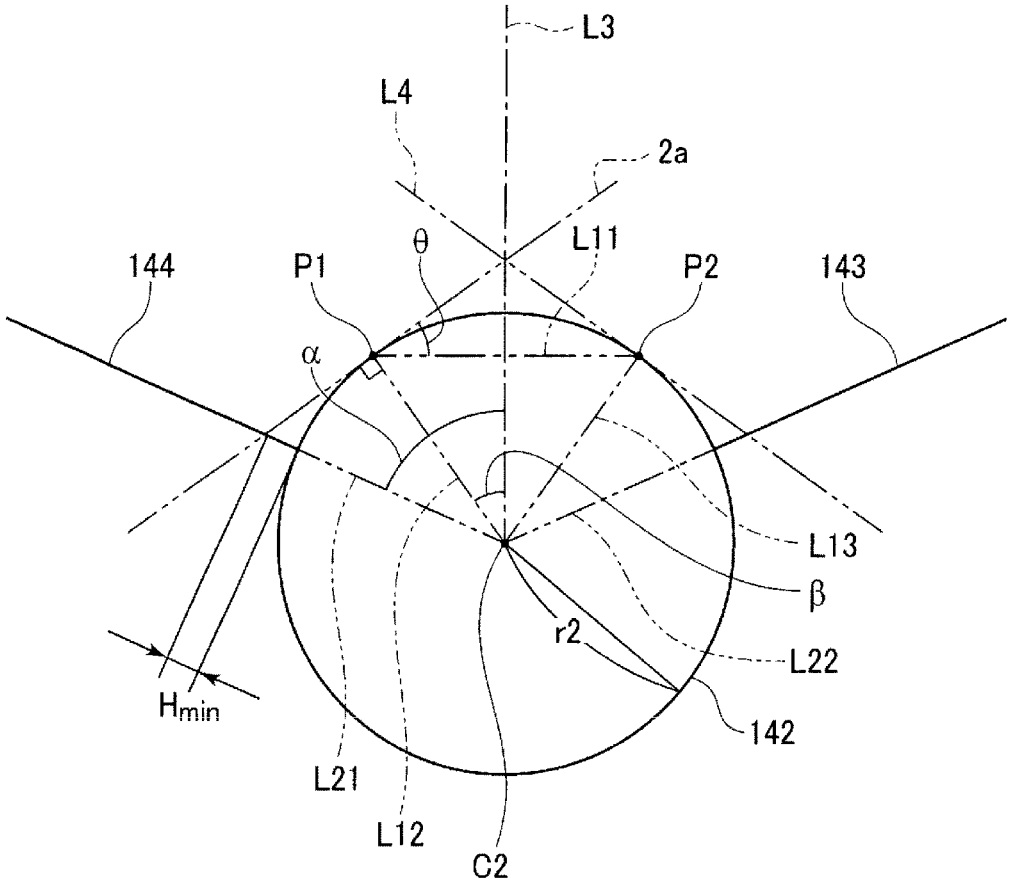
FIG. 3 is a magnified view of a feed pipe provided on the coal deactivation processing device.

As illustrated in FIG. 2 and FIG. 3, the feed pipe 142 has a circular cross-section in the radial direction. The blades 143, 144 are provided as a pair on the outer circumferential section of the feed pipe 142 and protrude toward the radial direction of the feed pipe 142. The pair of the blades 143, 144 are arranged at respective positions so as to, similarly to the feed pipe 142, upon rotation of the rotary kiln body 103, pass through the accumulated coal layer of the coal 2 despite the fill ratio of the coal 2 within the rotary kiln body 103 being from 10 to 15%, for example. The feed pipes 142 and the pair of the blades 143, 144 provided on each of the feed pipes 142 are arranged such that the angle γ is from 0 to 40°. This is because having the angle γ be smaller than 0° or greater than 40° prevents the coal 2 from being lifted by the pair of blades 143, 144 higher than the coal layer surface 2*a*, such that lifting of the coal 2 is only possible for the feed pipes 142. As a result, the volume of coal lifted higher than the coal layer surface 2*a* by the feed pipes 142 and by the pair of blades 143, 144 may be increased in comparison to a situation in which no blades are provided, and the coal dropped onto the coal layer surface 2*a* from above may be brought into contact with the processing gas 13 in a more efficient manner.

The feed pipes 142 and the pair of blades 143, 144 provided on each of the feed pipes 142 are preferably arranged such that the angle γ is equal to the angle of repose θ. This is because having the angle γ and the angle of repose θ be equal (see FIG. 3) maximizes the volume of the coal lifted higher than the coal layer surface 2*a* by the feed pipes 142 and by the pair of blades 143, 144, and enables a maximum benefit of efficiently bringing the coal 2 and the processing gas 13 into contact, which is caused by the angle γ.

Furthermore, the pair of blades 143, 144 are preferably arranged such that the angle (the blade angle) α is greater than the angle of repose θ. This is because having the angle (the blade angle) α be smaller than the angle of repose correspondingly decreases the volume of the coal lifted higher than the coal layer surface 2*a* by the feed pipes 142 and by the pair of blades 143, 144, and this prevents the coal 2 and the processing gas 13 from being brought into contact in an efficient manner.

The angle (the blade angle) α is preferably from 45 to 85°, and is more preferably from 55 to 75°. This is because having the angle (the blade angle) α be outside this range correspondingly decreases the volume of the coal lifted higher than the coal layer surface 2*a* by the feed pipes 142 and by the pair of blades 143, 144, and this prevents the coal 2 and the processing gas 13 from being brought into contact in an efficient manner.

A minimum length $H_{min}$ of each of the blades 143, 144 in the radial direction of the corresponding feed pipe 142 is preferably from 5 to 45%, and more preferably from 10 to 35%, of the radius of the feed pipe 142. This is because having the minimum length $H_{min}$ of the blades 143, 144 be below this lower limit causes the volume of the coal lifted by the feed pipes 142 and by the pair of blades 143, 144 to be similar to a situation in which the blades 143, 144 are not provided. As such, this prevents the volume of the coal lifted higher than the coal layer surface 2*a* by the blades 143, 144 from being increased, such that no improvement to the efficiency of bringing the coal 2 and the processing gas 13 into contact is possible. Conversely, having the minimum length $H_{min}$ of the blades 143, 144 be above this upper limit causes the volume of the coal lifted by the feed pipes 142 and by the pair of blades 143, 144 to be greater and as such increases a load imposed on the feed pipes 142 themselves and on connecting portions of the feed pipes 142 and the blades 143, 144.

Furthermore, the above-described coal deactivation processing device 100 preferably satisfies the relationship of formula (1) given below, where a given feed pipe 142 has a radius r2 and a distance D1 is defined from the central axis C1 of the rotary kiln body 103 to the central axis C2 of the given feed pipe 142.

$$\frac{1}{50}D1 < r2 < \frac{1}{10}D1 \quad (1)$$

In a situation where the radius r2 of the feed pipe 142 is equal to or greater than 1/10 D1 (one-tenth of D1), the pipe diameter of the feed pipe 142 is overly large in comparison to the thickness of the coal layer within the rotary kiln body 103. Given that the flow of the coal 2 is increased, this leads to the promotion of pulverization of the coal 2. Conversely, in a situation where the radius r2 of the feed pipe 142 is equal to or less than 1/50 D1 (one-fiftieth of D1), the feed pipe 142 is narrow and heat exchange is not possible unless many of the feed pipes 142 are arranged in the layer of the coal 2. This not only increases equipment costs, but also increases the supply pressure of the coolant 21 supplied to the feed pipes 142, and consumes a greater amount of power. As a result, satisfying formula (1), given above, enables pulverization of the coal 2 to be constrained, and also enables equipment cost increases and power consumption increases to be constrained.

$$2r2 < D3 < 6r2 \quad (2)$$

In a situation where a distance D3 between neighboring feed pipes 142, 142 is equal to or less than 2r2 (twice the radius r2 of each of the feed pipes 142), then the neighboring feed pipes 142, 142 are too close to each other and the coal 2 may bridge the space between the neighboring feed pipes 142, 142. Conversely, in a situation where the distance D3 between the neighboring feed pipes 142, 142 is equal to or greater than 6r2 (six times the radius r2 of each of the feed pipes 142), then a heat transfer surface area between the coolant 21 within the feed pipes 142 and the coal 2 is reduced and as such, the cooling heat transfer surface area may not be secured for the coal 2. Thus, satisfying formula (2), given above, enables the occurrence of bridging of the space between the neighboring feed pipes 142, 142 to be constrained and enables the cooling heat transfer surface area of the coolant 21 within the feed pipes 142 to be secured for the coal 2.

In the present embodiment, the processing gas supply pipe 121, the heating device 128, the blower 127, the air supply pipe 122, the flow rate regulation valve 125, the nitrogen supply pipe 123, the flow rate regulation valve 126, the nitrogen supply source 124, the base end side casing 111, the gas intake aperture 111*a*, and the like constitute processing gas supply means. The coolant feed header 141, the feed pipe 142, the blades 143, 144, the bearing 145, the coolant ejection header 146, and the like constitute the cooling device 140, which serves as cooling means. The projecting portion 104, the roller 105, the gear 106, the drive motor 107, the gear 107*a*, and the like constitute rotation means. The hopper 101, the screw feeder 102, and the like constitute coal supply means. The chute 112*b* of the tip end side casing 112 and the like constitute coal ejection means. The tip end side casing 112, the gas ejection aperture 112*a*, the processing gas ejection pipe 131, and the like constitute processing gas ejection means. Each of these means and the rotary kiln body 103, the sealing devices 108, 109*a*, 109*b*, and the like constitute the coal deactivation processing device 100.

Operations centered on the coal deactivation processing device 100 are described next.

Upon being supplied to the hopper 101, the coal 1 is transported by the screw feeder 102 within the rotary kiln body 103. At the other end, the air 11 and the nitrogen gas 12 are supplied to the processing gas supply pipe 121 via the air supply pipe 122 and the nitrogen supply pipe 123 by controlling a degree of aperture of the flow rate regulation valves 125, 126 while controlling the operation of the blower 127. As a result, the processing gas 13 is obtained by combining the air 11 and the nitrogen gas 12 (for example, with an oxygen concentration on the order of from 5 to 10%). The processing gas 13 is heated by the heating device 128 in accordance with temperature data of the used processing gas 14 obtained by the temperature sensor 131*a* so that the temperature inside the rotary kiln body 103 is adjusted to within a range of from 40 to 200° C. The processing gas 13 is then supplied within the rotary kiln body 103 by the processing gas supply pipe 121 via the gas intake aperture 111*a*.

The rotary kiln body 103 is driven to rotate by the rotation of the gear 107*a* of the drive motor 107 being transmitted via the gear 106. The coal 2 transported within the rotary kiln body 103 along with the rotation of the rotary kiln body 103 is displaced from the base end side to the tip end side of the rotary kiln body 103 while being agitated. At this time, the coal 2 within the rotary kiln body 103 adsorbs the oxygen in the processing gas 13 supplied within the rotary kiln body 103. The coal 2 thus becomes the deactivation processed coal (upgraded coal) 3 as a result of this oxygen adsorption, and is then transported to outside the system via the chute 112*b*. The coal 2 in the rotary kiln body 103 produces heat by adsorbing the oxygen in the processing gas 13. The temperature is therefore adjusted by the flow of the coolant 21 within the feed pipes 142 to a temperature at which spontaneous combustion of the coal 2 does not occur.

The used processing gas (approximately from 50 to 70° C.) 14 that has been used in the deactivation processing of the coal 2 within the rotary kiln body 103 flows in the same direction as the direction of transport of the coal 2. The used processing gas 14 flows from the gas ejection aperture 112*a* of the tip end side casing 112 provided on the tip end side of the rotary kiln body 103 to the processing gas ejection pipe 131, and is ejected outside the system via the processing gas ejection pipe 131.

Here, in the above-described coal deactivation processing device 100, the plurality of feed pipes 142 are provided within the rotary kiln body 103 so as to rotate about the central axis C1 of the rotary kiln body 103 along with the rotary kiln body 103 upon rotation of the rotary kiln body 103 so as to pass through the accumulated coal layer of the coal 2 supplied to the rotary kiln body 103, and the pair of blades 143, 144 are provided on each of the feed pipes 142. Given the various parameters described above, the following operations are further obtained.

That is, in the present embodiment, the plurality of feed pipes 142 are driven to rotate about the central axis C1 of the rotary kiln body 103 along with the rotation of the rotary kiln body 103. Also, upon passing through the coal layer, the coal 2 is lifted by the feed pipes 142 and the respective pairs of blades 143, 144 higher than the coal layer surface 2*a*. Thus, each pair of blades 143, 144 is made to lift the coal 2 within a range that is wider than the region in which the coal is lifted at the angle of repose θ.

As a result, according to the coal deactivation processing device 100 pertaining to the present embodiment, each of the feed pipes 142 and the pairs of blades 143, 144 are arranged so as to pass through the accumulated coal layer of the coal 2 within the rotary kiln body 103 upon rotation of the rotary kiln body 103, and are disposed such that the angle γ formed by the tangent line L2 of the path along which the central axis C2 of each of the feed pipes 142 pass and the bisector line L3 of the respective pairs of blades 143, 144 is from 0 to 40°. As such, the coal 2 is agitated by the rotation of the rotary kiln body 103 while the coal 2 is also cooled by the coolant 21 flowing in the feed pipes 142. In addition, a predetermined volume of the coal 2 is lifted up by the feed pipes 142 and the blades 143, 144 higher than the coal layer surface 2*a* within the rotary kiln body 103 and dropped from above, thus enabling agitation of the coal 2 and bringing the coal 2 and the processing gas 13 into contact in an efficient manner. As a result, the spontaneous combustion of the coal 2 may be prevented while causing oxygen to be adsorbed to the surface of the coal 2 in an efficient manner. As such, in comparison to a situation in which the blades are not provided on the feed pipes, the overall length of the rotary kiln body 103 may be made shorter, thus enabling miniaturization of the device.

[Other Embodiments]

Here, the blade angle α of the pair of blades 143, 144 provided on each of the plurality of feed pipes 142 is not limited to a single type. Two or more types of angles may be used in the coal deactivation processing device.

The coal deactivation processing device 100 has been described above as being equipped with eight of the feed pipes 142. However, the quantity of the feed pipes is not limited to eight. The coal deactivation processing device may also be equipped with seven or fewer and with nine or more of the feed pipes.

REFERENCE SIGNS LIST

1, 2, 3 Coal
11 Air
12 Nitrogen gas
13, 14 Processing gas
21, 22 Coolant
100 Coal deactivation processing device
101 Hopper
102 Screw feeder
103 Rotary kiln body (Kiln body)
104 Projecting portion
105 Roller
106 Gear
107 Drive motor
107*a* Gear
108 Sealing device
109*a*, 109*b* Sealing device
111 Base end side casing
111*a* Gas intake aperture
112 Tip end side casing
112*a* Gas ejection aperture
112*b* Chute
121 Processing gas supply pipe
122 Air supply pipe
123 Nitrogen supply pipe
124 Nitrogen supply source
125, 126 Flow rate regulation valve
127 Blower
128 Heating device
131 Processing gas ejection pipe
131*a* Temperature sensor
140 Cooling device
141 Coolant feed header
142 Feed pipe
143, 144 Blade

145 Bearing
146 Coolant ejection header
A Rotation direction of rotary kiln body
C1 Central axis of rotary kiln body
C2 Central axis of feed pipe
D1 Distance between central axis of rotary kiln body and central axis of feed pipe
D3 Distance between neighboring feed pipes
$H_{min}$ Minimum blade length
L1 Path of central axis of feed pipe
L2 Tangent line of path of central axis of feed pipe
L3 Bisector line of pair of blades
L4 Lateral symmetry line of coal layer surface
L11 Support line
L12, L13 Radial direction line of feed pipe
L21 L22 Support line of blade
P1, P2 Point of contact
r1 Radius of rotary kiln body
r2 Radius of feed pipe
α Blade angle
θ Angle of repose
β Angle between line L3 and line L12

The invention claimed is:

1. A coal deactivation processing device performing deactivation of coal with a processing gas that includes oxygen, comprising:

a kiln body provided rotatably into which the coal and the processing gas are supplied; and a feed pipe provided so as to be able to rotate along with the kiln body, extending along a lengthwise direction of the kiln body, and having a coolant flowing therein, the feed pipe being supported by jigs arranged at a plurality of locations in a lengthwise direction of the kiln body, a pair of blades being provided on an outer circumferential section of the feed pipe and protruding in a radial direction, and the feed pipe and the pair of blades being arranged so as to pass through an accumulated coal layer of the coal within the kiln body upon rotation of the kiln body, and such that an angle formed by a tangent line of a path along which a central axis of the feed pipe passes and a bisector line of the pair of blades is from 0 to 40°, wherein the pair of blades is arranged such that a blade angle formed by one blade of the pair of blades and the bisector line of the pair of blades is from 45 to 85°.

2. The coal deactivation processing device according to claim 1, wherein a minimum blade length in the radial direction of the feed pipe is from 5 to 45% of a radius of the feed pipe.

* * * * *